US009701502B2

(12) United States Patent
Miyamoto

(10) Patent No.: US 9,701,502 B2
(45) Date of Patent: Jul. 11, 2017

(54) IMAGE FORMING APPARATUS

(71) Applicant: KYOCERA Document Solutions Inc., Osaka (JP)

(72) Inventor: Kenji Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 79 days.

(21) Appl. No.: 14/693,187

(22) Filed: Apr. 22, 2015

(65) Prior Publication Data

US 2015/0307302 A1 Oct. 29, 2015

(30) Foreign Application Priority Data

Apr. 25, 2014 (JP) ..... 2014-091209

(51) Int. Cl.

| | |
|---|---|
| ***B65H 9/14*** | (2006.01) |
| ***B65H 9/00*** | (2006.01) |
| *B65H 5/26* | (2006.01) |
| *B65H 7/20* | (2006.01) |
| *B65H 5/06* | (2006.01) |

(Continued)

(52) U.S. Cl.

CPC ..... *B65H 9/006* (2013.01); *B65H 9/14* (2013.01); *G03G 15/6564* (2013.01); *B65H 5/062* (2013.01); *B65H 5/26* (2013.01); *B65H 7/02* (2013.01); *B65H 7/20* (2013.01); *B65H 2301/331* (2013.01); *B65H 2404/611* (2013.01); *B65H 2404/7231* (2013.01); *B65H 2513/10* (2013.01); *B65H 2513/50* (2013.01); *B65H 2513/514* (2013.01); *B65H 2701/1311* (2013.01); *G03G 15/6561* (2013.01); *G03G 2215/00721* (2013.01)

(58) Field of Classification Search

CPC ..... B65H 9/004; B65H 9/006; B65H 9/008; B65H 9/14; B65H 2301/331; B65H 2404/7231; G03G 15/6564; G03G 15/6561

See application file for complete search history.

(56) References Cited

U.S. PATENT DOCUMENTS 5,967,506 A * 10/1999 Miki ..... B65H 9/06 271/10.13
6,076,821 A * 6/2000 Embry ..... B65H 7/18 271/10.01

(Continued)

FOREIGN PATENT DOCUMENTS

| | | | |
|---|---|---|---|
| JP | 2005-219895 | A | 8/2005 |
| JP | 2005-335935 | A | 12/2005 |
| JP | 2009-196768 | A | 9/2009 |

*Primary Examiner* — Michael McCullough
(74) *Attorney, Agent, or Firm* — Studebaker & Brackett PC

(57) ABSTRACT

An image forming apparatus includes a pair of registration rollers, a pair of intermediate rollers, a registration sensor, and a control section that performs rotation control on the pair of registration rollers and the pair of intermediate rollers. The control section changes a starting timing of slowdown control according to a time when the registration sensor detects arrival of recording paper. The control section changes a period of time from completion of the slowdown control to start of increasing the rotational speed of the pair of registration rollers and the rotational speed of the pair of intermediate rollers from a lower speed limit to a steady state speed according to the change of the starting timing of the slowdown control.

1 Claim, 5 Drawing Sheets

(51) Int. Cl.
*B65H 7/02* (2006.01)
*G03G 15/00* (2006.01)

(56) References Cited

U.S. PATENT DOCUMENTS

| | | | | |
|---|---|---|---|---|
| 8,752,828 | B2 * | 6/2014 | Nakamura | B65H 7/02 271/242 |
| 8,814,163 | B2 * | 8/2014 | Yamagata | B65H 9/006 271/265.01 |
| 2012/0027426 | A1 * | 2/2012 | Maruta | G03G 15/6564 399/16 |
| 2012/0248677 | A1 * | 10/2012 | Nakamura | B65H 7/02 271/3.18 |
| 2012/0256365 | A1 * | 10/2012 | Yamagata | B65H 9/006 271/10.11 |

* cited by examiner

IMAGE FORMING APPARATUS

INCORPORATION BY REFERENCE

The present application claims priority under 35 U.S.C. §119 to Japanese Patent Application No. 2014-091209, filed Apr. 25, 2014. The contents of this application are incorporated herein by reference in their entirety.

BACKGROUND

The present disclosure relates to an image forming apparatus. More particularly, the present disclosure relates to a technique for adjusting a timing of secondary sheet feeding by a pair of registration rollers.

In a technique employed in image forming apparatuses such as copiers and printers, a pair of registration rollers feeds recording paper to a transfer point as secondary sheet feeding. The pair of registration rollers is disposed upstream of the transfer point in terms of a recording paper conveyance direction. Δt the transfer point, a toner image is transferred onto the recording paper by a photosensitive drum and a transfer roller. The pair of registration rollers adjusts a timing of conveyance of the recording paper to the transfer point. Specifically, the pair of registration rollers suspends temporarily conveyance of the recording paper, and then feeds the recording paper to the transfer point. The pair of registration rollers corrects skew of the recording paper. In the skew correction, a registration sensor detects the time when the recording paper arrives at the pair of registration rollers. The control section uses the time for controlling a starting timing of the secondary sheet feeding by the pair of registration rollers. The registration sensor is disposed in the vicinity of the pair of registration rollers.

In secondary sheet feeding by a pair of registration rollers in a general image forming apparatus, an upstream roller is rotated while a pair of registration rollers is in a suspended state. The upstream roller is located upstream of the pair of registration rollers in terms of a recording paper conveyance direction. The rotation of the upstream roller causes flexing of the recording paper. A high-speed apparatus resumes rotation of the pair of registration rollers at a starting timing of the secondary sheet feeding after the formation of the flexing of the recording paper. However, the rotational speed of the pair of registration rollers is different from the rotational speed of the upstream roller. The rotation of the upstream roller is therefore suspended. Then, the rotation of the pair of registration rollers and the rotation of the upstream roller need to be synchronized. Suspending the rotation of the upstream roller takes some time. Resuming the rotation of the upstream roller also takes some time. Consequently, the productivity desired for the image forming apparatus (the number of printed A4 recording paper sheets per minute: PPM) may not be achieved.

Some image forming apparatuses cause flexing of recording paper being fed to a conveyance belt without suspending rotation of the conveyance belt for conveyance of the recording paper.

SUMMARY

An image forming apparatus according to an aspect of the present disclosure includes a paper feed section, an image forming section, a conveyance path, a pair of registration rollers, a pair of upstream rollers, a first sensor, and a control section. The paper feed section stores therein and feeds therefrom recording paper. The image forming section has an image bearing member, and forms a toner image on a surface of the image bearing member and transfers the toner image onto the recording paper at a transfer point to form an image on the recording paper. The recording paper is conveyed from the paper feed section to the transfer point along the conveyance path. The pair of registration rollers is located upstream of the transfer point in terms of a conveyance direction of the recording paper along the conveyance path and adjusts a timing of the conveyance of the recording paper to the transfer point. The pair of upstream rollers conveys, toward the pair of registration rollers, the recording paper being conveyed along the conveyance path. The first sensor is located upstream of the pair of registration rollers in terms of the conveyance direction of the recording paper and detects the recording paper being conveyed from the pair of upstream rollers toward the pair of registration rollers. The control section performs rotation control on the pair of registration rollers and the pair of upstream rollers in such a manner that the control section controls the pair of upstream rollers to rotate while keeping the pair of registration rollers in a suspended state in order to cause flexing of the recording paper that has arrived at the pair of registration rollers, and then controls the pair of registration rollers to rotate so as to convey the recording paper to the transfer point. The control section performs slowdown control for decreasing the rotational speed of the pair of upstream rollers from a steady state speed to a lower speed limit. The control section changes a starting timing of the slowdown control according to a time when the first sensor detects arrival of a leading end of the recording paper. The control section changes a period of time from completion of the slowdown control to start of increasing the rotational speed of the pair of registration rollers and a period of time from completion of the slowdown control to start of increasing the rotational speed of the pair of upstream rollers according to the change of the starting timing of the slowdown control.

DETAILED DESCRIPTION

Figure 1:
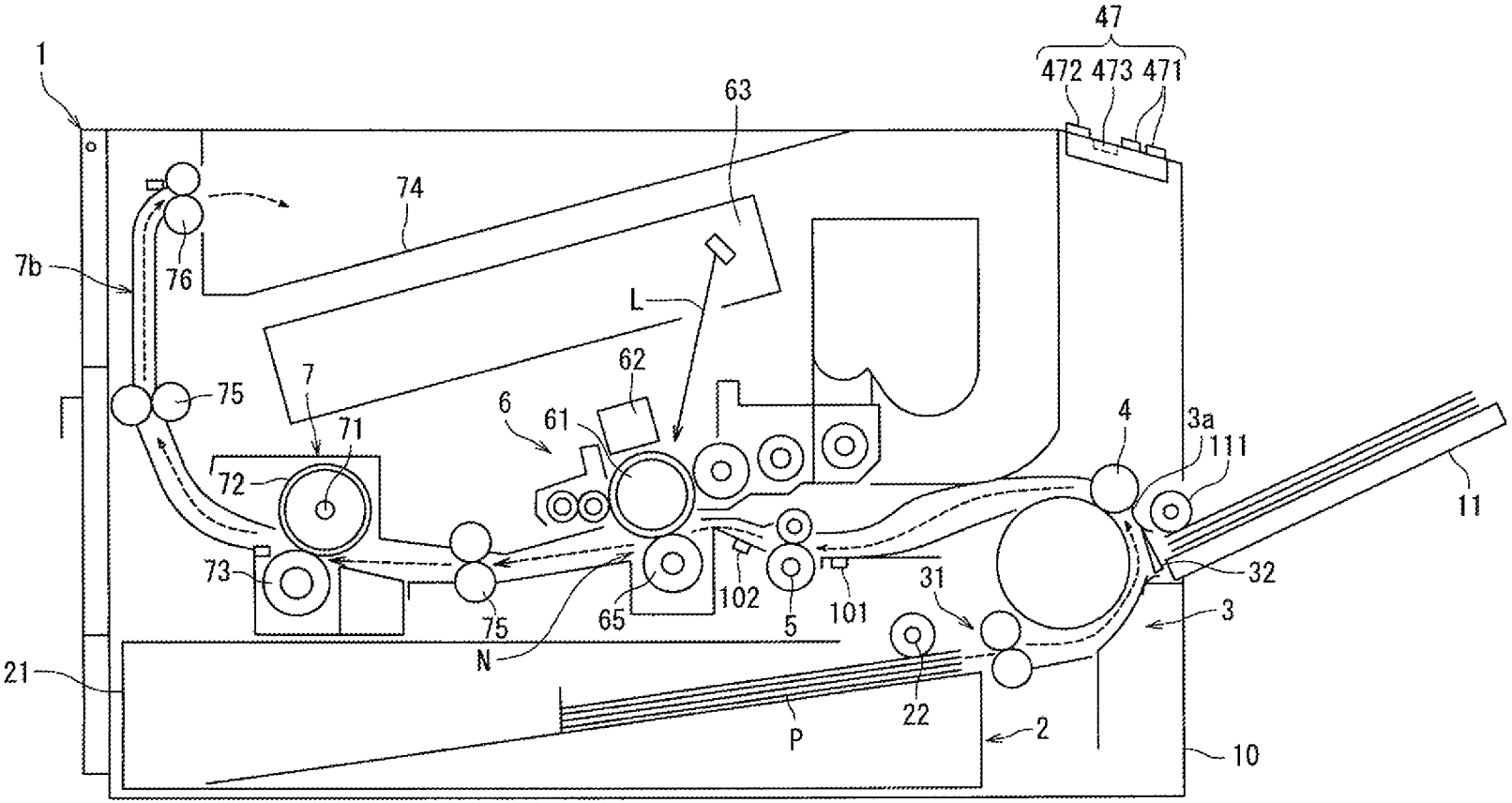
FIG. 1 is a diagram illustrating mechanical configuration of an image forming apparatus according to an embodiment of the present disclosure.

Hereinafter, an image forming apparatus according to an embodiment of the present disclosure will be described with reference to the accompanying drawings. FIG. 1 is a diagram illustrating mechanical configuration of an image forming apparatus 1 according to the embodiment of the present disclosure.

FIG. 1 shows an electrophotographic printer as the image forming apparatus 1 according to the embodiment of the present disclosure.

An operation section 47 is disposed in an upper region of the image forming apparatus 1. The operation section 47 includes a display section 473. The display section 473 is a display device such as a liquid crystal display (LCD). The display section 473 displays to an operator the state of the image forming apparatus 1 and/or various messages. The operation section 47 further includes operation keys 471 and a lighting section 472. The operation keys 471 are used by an operator for setting a type (kind) and/or a size of recording paper to be used in image formation. The lighting section 472 is for example a light emitting diode (LED). The lighting section 472 turns on or off to inform of the state (e.g., a job in execution, an error such as a jam (paper jam), and so on) of the image forming apparatus 1.

A paper feed section 2 is disposed in a lower region of the inside of a main body 10 of the image forming apparatus 1. The paper feed section 2 has a detachable paper feed cassette 21 inside of the main body 10. The paper feed cassette 21 stores therein a stack of sheets of recording paper P. The paper feed section 2 further includes a paper feed roller 22. The paper feed roller 22 comes into contact with a topmost sheet of recording paper P of the stack of recording paper P stored in the paper feed cassette 21. The paper feed roller 22 is then driven to rotate by rotation driving force from a conveyance motor, not shown. The rotation driving force from the conveyance motor causes the recording paper P to be picked up sheet by sheet in order from the topmost sheet to be fed from the paper feed cassette 21 to a conveyance path 3.

The conveyance path 3 extends from the paper feed section 2 to an exit tray 74 along an image forming section 6 and a fixing section 7. The conveyance path 3 guides the recording paper P from the paper feed section 2 to the exit tray 74. That is, the recording paper P is conveyed from the paper feed section 2 to a transfer point N along the conveyance path 3. The conveyance path 3 is provided with a pair of separating rollers 31, a pair of intermediate rollers 4, and a pair of registration rollers 5 that are located upstream of the image forming section 6 in terms of the conveyance direction of the recording paper P and arranged in order from an upstream end of the conveyance direction of the recording paper P. These pairs of rollers convey the recording paper P fed by the paper feed roller 22 toward the image forming section 6 along the conveyance path 3.

A manual feed tray 11 is provided in a front side of the image forming apparatus 1. The manual feed tray 11 turns so that it is opened and closed relative to a side of the main body 10. A plurality of sheets of recording paper P are loaded onto the manual feed tray 11 in an opened state (a state shown in FIG. 1). A paper feed roller 111 is disposed in the main body 10 and above the recording paper P loaded on the manual feed tray 11. The conveyance path 3 leads to and out of the manual feed tray 11 and the paper feed roller 111. The conveyance path 3 has a portion 3*a* provided with a switching guide 32. The manual feed tray 11 and the paper feed roller 111 lead to the portion 3*a* of the conveyance path 3.

The pair of intermediate rollers 4 conveys the recording paper P conveyed thereto by the pair of separating rollers 31 along the conveyance path 3 toward the pair of registration rollers 5 and the image forming section 6. The pair of intermediate rollers 4 is an example of the pair of upstream rollers.

The pair of registration rollers 5 is located upstream of the toner image transfer point N of the image forming section 6 and downstream of the pair of intermediate rollers 4 in terms of the conveyance direction of the recording paper P along the conveyance path 3. The pair of registration rollers 5 is controlled to rotate and stop by an engine control section 9 to be described later. Specifically, the pair of registration rollers 5 is controlled by the engine control section 9 to send the recording paper P that has come into contact with a nip thereof to the transfer point N at a specific timing. The pair of registration rollers 5 is capable of adjusting the timing of conveyance of the recording paper P to the transfer point N.

The conveyance path 3 is provided with a registration sensor 101 as a first sensor located upstream of the pair of registration rollers 5 and downstream of the pair of intermediate rollers 4 in terms of the conveyance direction of the recording paper P. The registration sensor 101 detects the recording paper P being conveyed from the pair of intermediate rollers 4 toward the pair of registration rollers 5. The registration sensor 101 is for example an optical sensor. The registration sensor 101 detects the recording paper P that has come to a position upstream of and in the vicinity of the pair of registration rollers 5 in terms of the conveyance direction of the recording paper P.

The conveyance path 3 is also provided with a sensor 102 as a second sensor located at a position upstream of the transfer point N of the image forming section 6 and downstream of the pair of registration rollers 5 in terms of the conveyance direction of the recording paper P. The sensor 102 is for example an actuator-sensor device. The sensor 102 detects the recording paper P being conveyed by the pair of registration rollers 5 toward the transfer point N.

For example, a recording paper detection signal is output from the registration sensor 101 and used for adjusting the starting timing of the rotation driving of the pair of registration rollers 5. The recording paper detection signal refers to a leading end detection signal that is output from the registration sensor 101. The leading end detection signal indicates that the registration sensor 101 has detected a leading end of the recording paper P. The recording paper detection signal output from the registration sensor 101 is also used for adjusting the timing of causing flexing of the recording paper. A recording paper detection signal output from the sensor 102 (a leading end detection signal indicating that the sensor 102 has detected a leading end of the recording paper P) is used for adjusting the starting timing of toner image formation on a photosensitive drum 61 by the image forming section 6.

The image forming section 6 has a photosensitive drum 61 as an image bearing member. The image forming section 6 forms a toner image on a surface of the photosensitive drum 61. The photosensitive drum 61 bears the toner image while rotating at a predetermined speed. A charger 62 is disposed above the photosensitive drum 61. The charger 62 charges the surface of the photosensitive drum 61 to a specific electric potential substantially uniformly. A light exposure section 63 is disposed downstream of the charger 62 in terms of the rotation direction of the photosensitive drum 61. The light exposure section 63 irradiates the photosensitive drum 61 with laser light L based on image data to form an electrostatic latent image on the surface of the photosensitive drum 61. The image data is sent from a computer 20 (FIG. 2) or the like network-connected to the image forming apparatus 1.

A development section 64 is disposed downstream of the light exposure section 63 in terms of the rotation direction of the photosensitive drum 61. The development section 64 supplies toner to the electrostatic latent image formed on the surface of the photosensitive drum 61 to form a toner image. A transfer roller 65 is disposed under the photosensitive drum 61. Transfer bias for transferring the toner image is applied to the transfer roller 65. The transfer roller 65 transfers the toner image on the surface of the photosensitive drum 61 onto the recording paper P that has come to the transfer point N. Through the transfer of the toner image onto the recording paper P, an image is formed on the recording paper P. The transfer point N is a nip between the transfer roller 64 and the photosensitive drum 61.

The fixing section 7 is disposed downstream of the transfer point N of the image forming section 6 in terms of the conveyance direction of the recording paper P. The fixing section 7 has a heating roller 72 and a pressure roller 73. The heating roller 72 has a heating element 71 therein. The pressure roller 73 and the heating roller 72 are in pressed contact with each other to form a nip therebetween. The recording paper P carrying the unfixed toner image transferred thereto goes into the nip between the heating roller 72 and the pressure roller 73 of the fixing section 7. Thereafter, heat and pressure applied by the rollers melt toner of the toner image, and thus the toner image is fixed to the recording paper P. The recording paper P having the fixed toner image is conveyed upward along an ejection conveyance path 7*b*. The ejection conveyance path 7*b* includes pairs of conveyance rollers 75 and a pair of ejection rollers 76. An exit tray 74 is disposed in the top of the main body. The recording paper P is ejected onto the exit tray 74 by the pairs of conveyance rollers 75 and the pair of ejection rollers 76.

Figure 2:
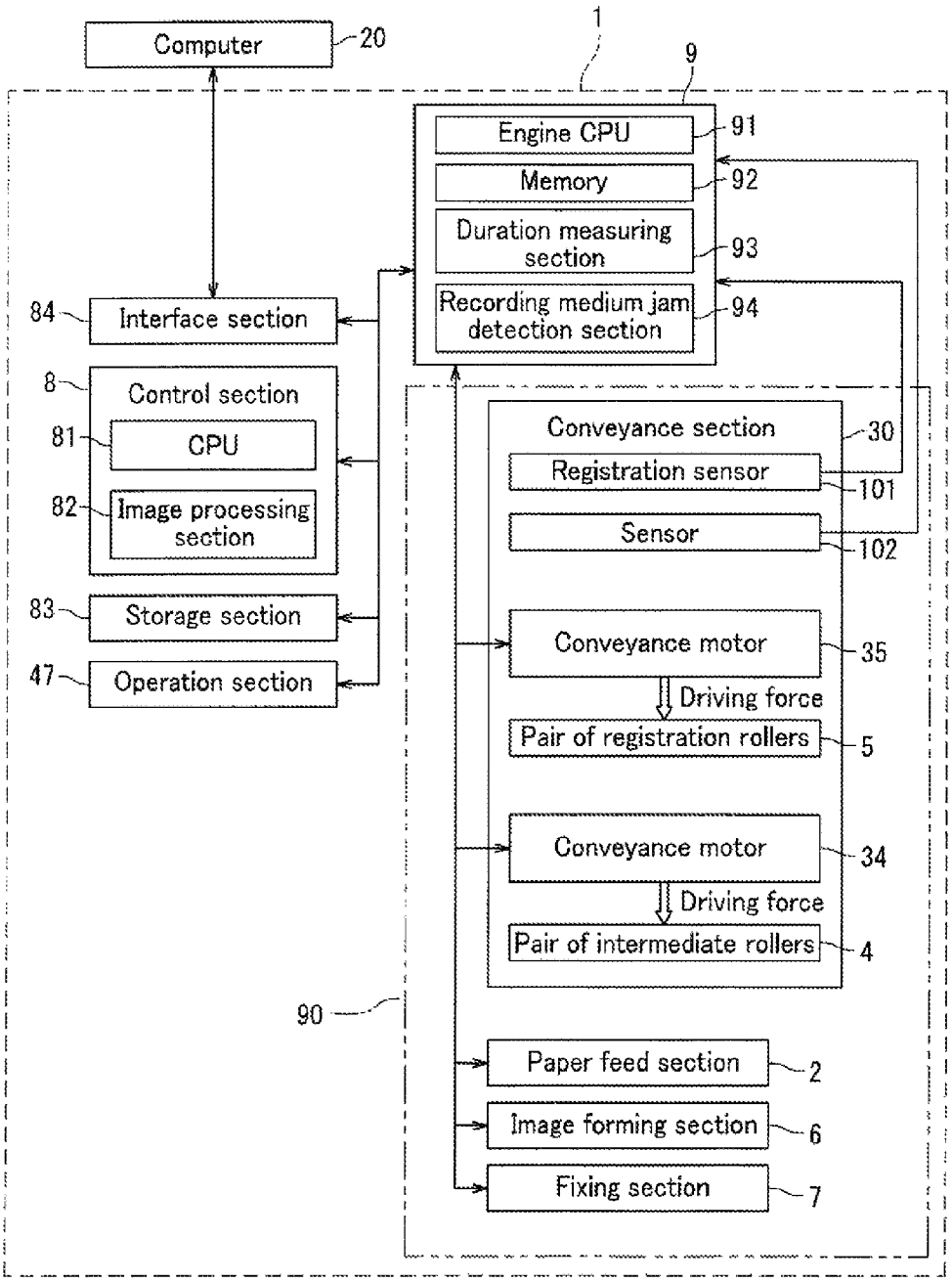
FIG. 2 is a block diagram illustrating electrical configuration of the image forming apparatus.

Next, electrical configuration of the image forming apparatus 1 will be described. FIG. 2 is a block diagram illustrating electrical configuration of the image forming apparatus 1.

As illustrated in FIG. 2, the image forming apparatus 1 has a control section 8 therein. The control section 8 performs overall control of the image forming apparatus 1. The control section 8 has a CPU 81, an image processing section 82, and so on. The control section 8 is connected with a storage section 83. The storage section 83 is a combination of a volatile memory and a non-volatile memory such as ROM, RAM, and flash ROM. For example, the storage section 83 stores therein a control program, control data, and so on of the image forming apparatus 1. The CPU 81 is a central processing unit. The CPU 81 performs computation and/or control of each section of the image forming apparatus 1 based on the control program and the control data stored in the storage section 83.

The image processing section 82 is a circuit including an ASIC, image processing RAM, and so on. The image processing section 82 performs various types of image processing on image data such as scaling up, scaling down, density conversion, and/or data format conversion according to settings. The image processing section 82 sends image data after the image processing to the light exposure section 63 (see FIG. 1). The light exposure section 63 performs scanning and light exposure based on the image data to form an electrostatic latent image on the photosensitive drum 61.

The control section 8 is connected with the operation section 47. The control section 8 receives an instruction input by an operator through operation of the operation keys 471 of the operation section 47. Furthermore, the control section 8 controls display by the display section 473 and lighting by the lighting section 472 of the operation section 47. In case of an error such as a jam, for example, the control section 8 controls the lighting section 472 to light up and controls the display section 473 to display a message pertaining to the error that has occurred.

The control section 8 is also connected with an interface section 84. The interface section 84 is a communication interface that enables communication with the computer 20 (e.g., a personal computer and a server device) through a network or a cable. The computer 20 sends printing data. The printing data includes data of an image to be printed and/or data of settings for the printing. The image forming apparatus 1 performs printing based on the image data and the setting data sent from the computer 20 and input to the interface section 84. The setting data to be input to the interface section 84 includes paper type information, paper size information, and so on. The paper type information represents a type of the recording paper P being used in the image formation (types such as plain paper, an OHP sheet, or the like). The paper size information represents a size of the paper that has been specified. The control section 8 (an example of the paper type information acquiring section) receives the setting data from the computer 20 through the interface section 84. That is, the control section 8 acquires the paper type information and the paper size information of the recording paper P being used in the printing through the interface section 84. The paper type information and the paper size information may be acquired by being input by an operator through operation of the operation keys 471 of the operation section 47 and received by the control section 8. The control section 8 shares with the later-described engine control section 9 the paper type information and the paper size information of the recording paper P that has been acquired.

The image forming apparatus 1 is provided with the engine control section 9 for control of an engine section 90 as a section engaged in image formation. The engine section 90 has the paper feed section 2, a conveyance section 30, the image forming section 6, and the fixing section 7, for example. The engine control section 9 has an engine CPU 91, a memory 92, a duration measuring section 93, and a recording medium jam detection section 94.

The engine CPU 91 is an arithmetic processing unit. The engine CPU 91 performs computation and processing based on a program or data stored in the memory 92. The memory 92 is ROM or RAM that stores therein a program and data for image formation-related control. The duration measuring section 93 measures a period of time taken for the control. The engine control section 9 may not have the duration measuring section 93, and the engine CPU 91 may perform the duration measuring. The recording medium jam detection section 94 detects a jam of the recording paper P in the conveyance path 3 based on the recording paper detection signals received from the registration sensor 101 and the sensor 102.

The engine CPU 91 of the engine control section 9 controls operation of each section of the engine section 90 so that an image is formed appropriately based on the control program and the control data for the printing stored in the memory 92. The control section 8 and the engine control section 9 in the present embodiment are examples of a control section. The present embodiment represents a case in which the image forming apparatus 1 is provided with the engine control section 9 that controls the sections engaged in image formation independently from the control section 8. Alternatively, the engine control section 9 may be integrated with the control section 8, and the control section 8 may perform the function and the processing of the engine control section 9.

The conveyance section 30 includes the conveyance path 3, the registration sensor 101, the sensor 102, conveyance motors 34 and 35, the pair of intermediate rollers 4, and the pair of registration rollers 5. The conveyance section 30 further includes a conveyance motor, not shown, the pairs of conveyance rollers 75, and the pair of ejection rollers 76. The pairs of conveyance rollers 75 and the pair of ejection rollers 76 receive rotation driving force from the conveyance motor to rotate.

The registration sensor 101 and the sensor 102 are driven under control by the engine control section 9. The registration sensor 101 and the sensor 102 output the recording paper detection signals to the engine control section 9.

The pair of intermediate rollers 4 is driven by the conveyance motor 34. The conveyance motor 34 is a dedicated motor. The pair of registration rollers 5 is driven by the conveyance motor 35. The conveyance motor 35 is a dedicated motor. The conveyance motors 34 and 35 may be stepper motors. The engine control section 9 separately drives and controls the conveyance motors 34 and 35 to rotate so that each of the pair of registration rollers 5 and the pair of intermediate rollers 4 rotates at a predetermined rotational speed.

The engine control section 9 controls the rotational speed of the conveyance motors 34 and 35 (the later-described speed control (FIG. 5)). The control of the rotational speed of the conveyance motors 34 and 35 allows the pair of intermediate rollers 4 and the pair of registration rollers 5 to each rotate at a rotational speed different from other rollers such as the paper feed rollers 22 and 111, the pair of separating rollers 31, the pairs of conveyance rollers 75, and the pair of ejection rollers 76. It should be noted that in the present specification, the rotational speed refers to a number of rotations per unit time.

Figure 3:
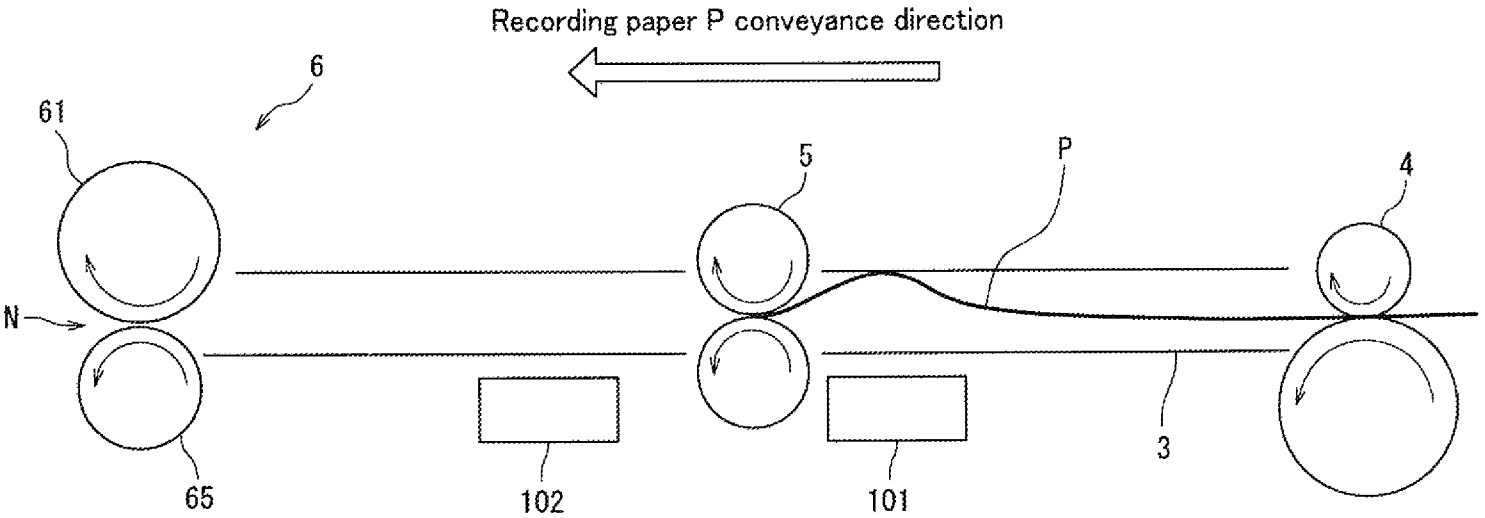
FIG. 3 is a side view illustrating configuration of a portion of a conveyance section around a position of a pair of registration rollers.

Next, formation of flexing of the recording paper P in the image forming apparatus 1 according to the embodiment will be described. FIG. 3 is a diagram illustrating configuration of a portion of the conveyance path 3 around the position of the pair of registration rollers 5. FIG. 3 shows a simplified positional relationship of the pairs of rollers relative to the pair of registration rollers 5.

As described above, the conveyance path 3 is provided with the registration sensor 101 located upstream of the pair of registration rollers 5 and downstream of the pair of intermediate rollers 4 in terms of the conveyance direction of the recording paper P. The registration sensor 101 detects the recording paper P being conveyed at a location upstream of and in the vicinity of the pair of registration rollers 5 in terms of the conveyance direction of the recording paper P.

The conveyance path 3 is also provided with the sensor 102 located upstream of the transfer point N of the image forming section 6 and downstream of the pair of registration rollers 5 in terms of the conveyance direction of the recording paper P. The sensor 102 detects the recording paper P being conveyed by the pair of registration rollers 5 toward the transfer point N.

The registration sensor 101 is for example an optical sensor. The registration sensor 101 includes a light emitting section (not shown) and a light receiving section (not shown). The light emitting section has a light emitting diode (LED) or the like and emits light to the conveyance path 3. The light receiving section has a photodiode or the like and receives light emitted by the light emitting section and reflected off the recording paper P.

The light emitted by the light emitting section is not received by the light receiving section while no recording paper P is passing the position of the registration sensor 101 because of the absence of the recording paper P. On the other hand, the light emitted by the light emitting section is reflected off the recording paper P and received by the light receiving section while the recording paper P is passing the position of the registration sensor 101.

The registration sensor 101 changes the output level (output voltage value) of the recording paper detection signal according to whether or not the reflected light is received by the light receiving section. For example, when the reflected light is not being received by the light receiving section, the registration sensor 101 outputs an off signal (low signal) to the recording medium jam detection section 94. The off signal is a recording paper detection signal indicating absence of the recording paper P. When the reflected light is being received by the light receiving section, the registration sensor 101 outputs an on signal (high signal) to the recording medium jam detection section 94. The on signal is a recording paper detection signal indicating presence of the recording paper P. The recording medium jam detection section 94 detects presence or absence of the recording paper P, arrival of a leading end and a trailing end of the recording paper P, and passing of the recording paper P at the position of the registration sensor 101 based on a state change of the signals output by the registration sensor 101 (e.g., based on a signal that is output, i.e, a high signal or a low signal; a change from a high signal to a low signal; or a change from a low signal to a high signal).

The sensor 102 is for example a mechanical switch. The sensor 102 includes an actuator (not shown). Pushed by the recording paper P, the actuator turns. The sensor 102 outputs an on signal indicating presence of the recording paper P when a contact thereof is closed by the turn of the actuator pushed by the recording paper P. On the other hand, the actuator does not turn when not pushed by the recording paper P. In this case, the contact of the sensor 102 is not closed, and the sensor 102 outputs an off signal indicating absence of the recording paper P.

The actuator of the sensor 102 is not pushed by the recording paper P unless the recording paper P has arrived at the position of the sensor 102. In this state, the actuator remains in a posture of protruding into the conveyance path 3. When the actuator is in the protruding posture, the contact inside of the sensor 102 is open. On the other hand, the actuator of the sensor 102 is pushed down by the recording paper P once the recording paper P has arrived at the position of the sensor 102 and thus turns into another posture. The contact inside of the sensor 102 is configured to be closed when the actuator is in this posture.

That is, when the contact is in the closed state, the sensor 102 outputs an on signal (high signal) as the recording paper detection signal indicating that the recording paper P has been detected. On the other hand, when the contact is in the open state, the sensor 102 outputs an off signal (low signal) as the recording paper detection signal indicating that the recording paper P has not been detected.

As in the case of the registration sensor 101, the recording medium jam detection section 94 detects presence or absence of the recording paper P, arrival of a leading end and a trailing end of the recording paper P, and passing of the recording paper P at the position of the sensor 102 based on a state change of the recording paper detection signals output by the sensor 102.

The engine control section 9 controls the pair of intermediate rollers 4 to convey the recording paper P, with the recording paper P abutting the pair of registration rollers 5. Thus, flexing of the recording paper P is caused. More specifically, the engine control section 9 controls the pair of intermediate rollers 4 to rotate and convey the recording paper P fed from the paper feed section 2 toward the pair of registration rollers 5. Then, the engine control section 9 recognizes that the registration sensor 101 has detected a leading end of the recording paper P having passed the pair of intermediate rollers 4 based on the output from the registration sensor 101. That is, the engine control section 9 recognizes arrival of the recording paper P at the registration sensor 101 based on the output from the registration sensor 101.

The engine control section 9 puts the pair of registration rollers 5 into a suspended state once the recording paper P arrives at the registration sensor 101. The engine control section 9 then controls the pair of intermediate rollers 4 to continue to rotate, that is, controls the pair of intermediate rollers 4 to continue to convey the recording paper P, with the pair of the registration rollers 5 in the suspended state. As a result, the leading end of the recording paper P abuts the pair of registration rollers 5, and thus flexing of the recording paper P is caused. The elastic force of the recording paper P with the flexing puts the leading end of the recording paper P along a nip between the pair of registration rollers 5. Thus, skew of the recording paper P is corrected. The engine control section 9 performs rotation control on the pair of intermediate rollers 4 and the pair of registration rollers 5 so that the recording paper P is conveyed to the transfer point N by the rotation of the pair of registration rollers 5 after flexing of the recording paper P is caused.

A certain image forming apparatus causes a predetermined degree of flexing of recording paper at a pair of registration rollers. Specifically, an engine control section starts counting the number of steps for causing flexing of recording paper once a leading end of the recording paper has been detected by a registration sensor. The engine control section drives a conveyance motor to rotate the number of steps, and then suspends the conveyance motor.

A certain image forming apparatus drives a conveyance motor to rotate the number of steps after a registration sensor has detected a leading end of recording paper as described above, and then suspends the conveyance motor to suspend the rotation of a pair of intermediate rollers. The image forming apparatus 1 according to the present embodiment performs slowdown control without suspending the pair of intermediate rollers 4. Under the influence of the slowdown control, the pair of intermediate rollers 4 continues to rotate at a lower speed limit. The lower speed limit is for example a starting speed.

The image forming apparatus 1 according to the present embodiment adjusts a starting timing of the slowdown control on the pair of intermediate rollers 4. Specifically, an error that has arisen between a time taken to increase the rotational speed of the pair of intermediate rollers 4 from the lower speed limit to a steady state speed and a registration time taken to increase the rotational speed of the pair of registration rollers 5 from the lower speed limit to a steady state speed is compensated. The compensation ensures that an appropriate degree of flexing of the recording paper P is always caused. Herein, the lower speed limit of the pair of registration rollers 5 is 0.

Figure 4:
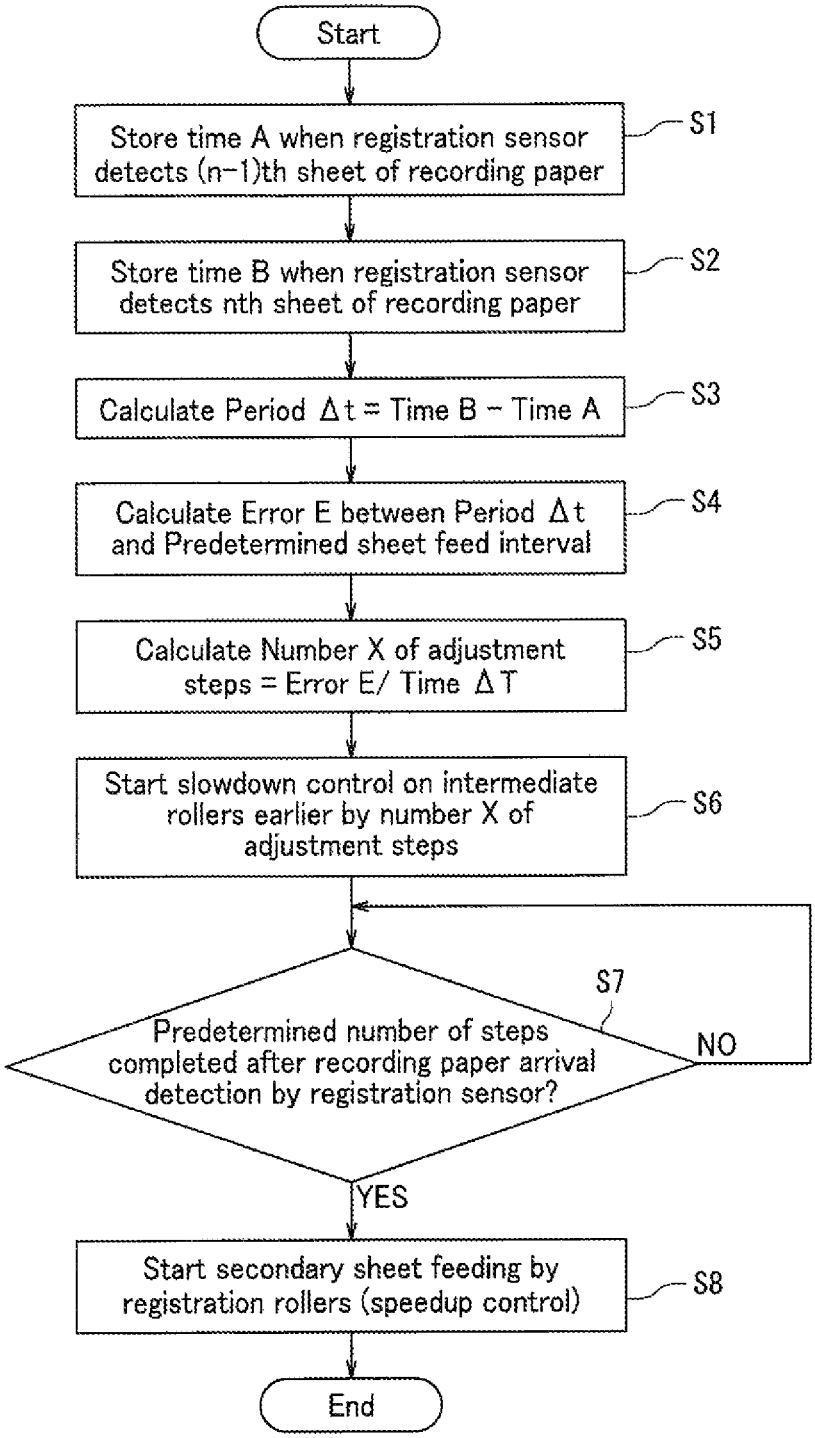
FIG. 4 is a flowchart showing rotation control on intermediate rollers in the image forming apparatus.

Hereinafter, rotation control on the pair of intermediate rollers 4 in the image forming apparatus 1 according to the present embodiment will be described. FIG. 4 is a flowchart showing the rotation control on the pair of intermediate rollers 4 in the image forming apparatus 1.

The engine control section 9 stores therein a time A (S1). The time A is a time when the registration sensor 101 detects a leading end of an $(n-1)_{th}$ sheet of recording paper P as a preceding sheet of recording paper P among two consecutive sheets of recording paper P being conveyed, with the pair of intermediate rollers 4 rotating at a steady state speed and the pair of registration rollers 5 in the suspended state. Subsequently, the engine control section 9 stores therein a time B (S2). The time B is a time when the registration sensor 101 detects a leading end of an $n_{th}$ sheet of recording paper P as the following sheet of recording paper P among the two consecutive sheets of recording paper P being conveyed, with the pair of intermediate rollers 4 rotating at the steady state speed and the pair of registration rollers 5 in the suspended state.

The engine control section 9 calculates a period $\Delta t$ (=B−A) elapsing between the time A and the time B (S3). The period $\Delta t$ represents a time from when the leading end of the $(n-1)_{th}$ sheet of recording paper P arrives at the registration sensor 101 till when the leading end of the $n_{th}$ sheet of recording paper P arrives at the registration sensor 101 (arrival time interval at the registration sensor).

Subsequently, the engine control section 9 calculates an error E (S4). The error E is a time difference between the period $\Delta t$ and a secondary sheet feed interval (sheet interval in consecutive sheet feeding). The secondary sheet feed interval is a default value predetermined for achieving the productivity desired for the recording paper P. For example, when the desired productivity is 60 ppm, the secondary sheet feed interval is 1,000 ms.

For example, when the secondary sheet feed interval is 1,000 ms and the period $\Delta t$ is 950 ms, the error E is 50 ms. The engine control section 9 compensates the error E by advancing the starting timing of the slowdown control on the pair of intermediate rollers 4. Specifically, the engine control section 9 advances the starting timing of the slowdown control instead of performing the slowdown control upon completion of a predetermined number of steps after detection of arrival of the recording paper P by the registration sensor 101. Specifically, the engine control section 9 starts the slowdown control before the predetermined number of steps are completed after detection of a leading end of the recording paper P by the registration sensor 101. That is, the engine control section 9 changes the starting timing of the slowdown control according to a time when the registration sensor detects arrival of a leading end of the recording paper P.

The engine control section 9 therefore calculates the number X of adjustment steps (S5). The number X of adjustment steps is determined by dividing the error E by an adjustment time $\Delta T$. The adjustment time $\Delta T$ is a predetermined period of time needed to drive the conveyance motors 34 and 35 to rotate one step at a steady state speed (a speed for achieving the predetermined productivity). The engine control section 9 then advances the start of the slowdown control on the pair of intermediate rollers 4 that is performed after detection of the recording paper P by the registration sensor 101 by a period of time for the number of adjustment steps X thus calculated (S6).

Thereafter, the engine control section 9 starts driving the conveyance motor 35 upon completion of a predetermined number of steps of rotation of the conveyance motor 34 after detection of the recording paper P by the registration sensor 101 (YES in S7). The engine control section 9 starts increasing the rotational speed of the conveyance motor 35 and starts increasing the rotational speed of the conveyance motor 34 (speedup control: S8). The engine control section 9 increases the rotational speed of the pair of registration rollers 5 and the rotational speed of the pair of intermediate rollers 4 from the lower speed limit to the steady state speed. Thus, the secondary sheet feeding by the pair of registration rollers 5 starts. That is, a period of time from the end of the slowdown control to the starting timing of the speedup control is extended by a period of time for the number X of adjustment steps. The speedup control performed on the conveyance motors 34 and 35 by the engine control section 9 increases the rotational speed of the pair of registration rollers 5 and the rotational speed of the pair of intermediate rollers 4 from the lower speed limit to the steady state speed.

Next, exemplary operation of the pair of intermediate rollers 4 and the pair of registration rollers 5 in the image forming apparatus 1 according to the present embodiment will be described. The description will be made on the assumption that the number of steps from detection of the recording paper P by the registration sensor 101 to completion of causing flexing (to the start of the speedup control on the conveyance motors 34 and 35) is 80, and the number of steps for the slowdown control on the pair of intermediate rollers 4 is 50.

Figure 5A:
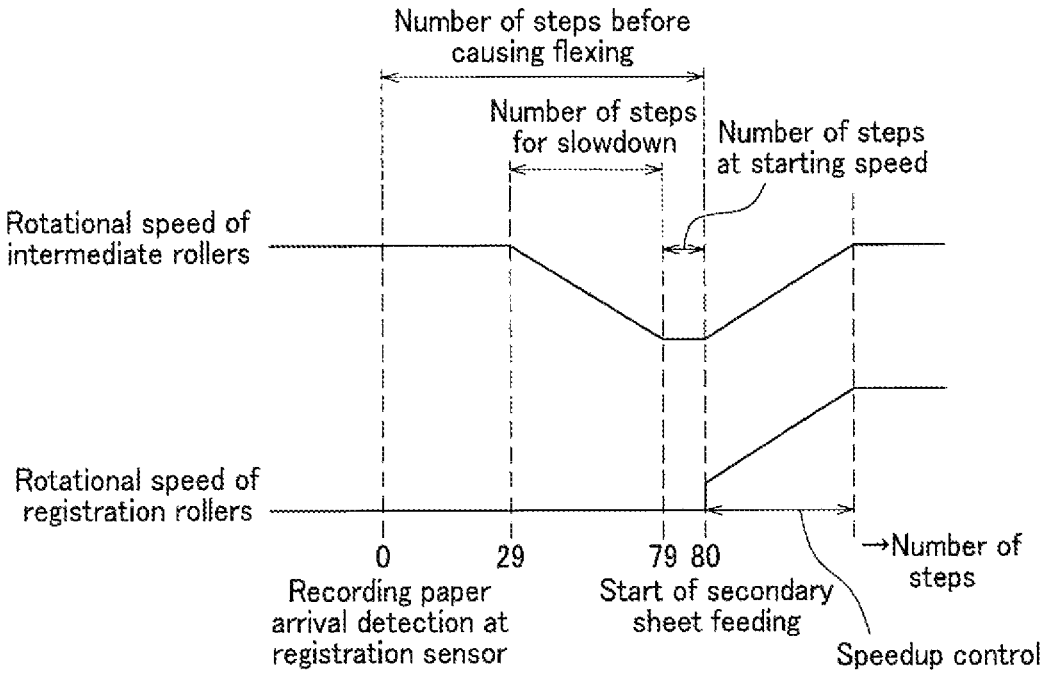
FIG. 5A is a graph showing exemplary changes in the rotational speed of the intermediate rollers and the rotational speed of the pair of registration rollers when a registration sensor detects arrival of recording paper at an appropriate timing.

FIG. 5A is a diagram illustrating exemplary changes in the rotational speed of the pair of intermediate rollers 4 and the rotational speed of the pair of registration rollers 5 when the registration sensor 101 detects arrival of the recording paper P at an appropriate timing. For example, the engine control section 9 starts the slowdown control after 29 steps from the detection of arrival of the recording paper P by the registration sensor 101 (arrival detection by the registration sensor). For example, the engine control section 9 performs the slowdown control so as to decrease the rotational speed of the pair of intermediate rollers 4 from the steady state speed to the starting speed, which is the lower speed limit That is, the engine control section 9 decreases the rotational speed of the pair of intermediate rollers 4 from the steady state speed to the starting speed through 50 steps from the start of the slowdown control.

The engine control section 9 controls the pair of intermediate rollers 4 to rotate at the starting speed by one step of rotation of the conveyance motor 34 once the slowdown control is complete. Thus, flexing of the recording paper P is caused. The engine control section 9 keeps the pair of registration rollers 5 in the suspended state during a period from the detection of arrival of the recording paper P at the registration sensor 101 to completion of causing flexing of the recording paper P. After 80 steps from the detection of arrival of the recording paper P at the registration sensor 101, the engine control section 9 increases the rotation speed of the pair of intermediate rollers 4 and the rotation speed of the pair of registration rollers 5 (starts the speedup control) in order to start secondary sheet feeding.

Figure 5B:
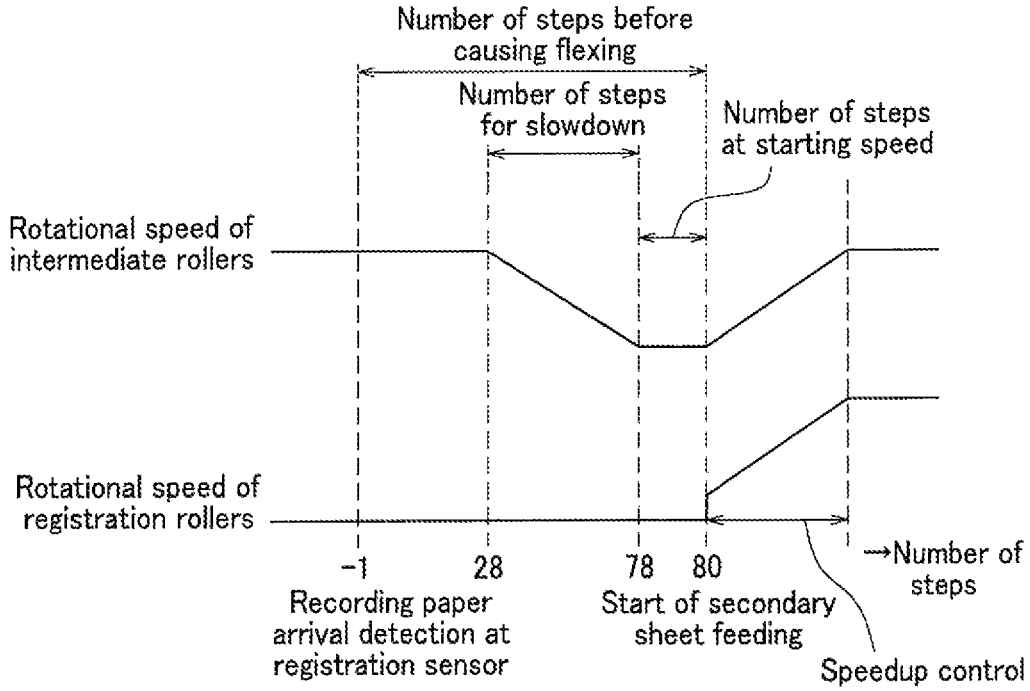
FIG. 5B is a graph showing exemplary changes in the rotational speed of the intermediate rollers and the rotational speed of the pair of registration rollers when the registration sensor detects arrival of recording paper earlier than the appropriate timing.

FIG. 5B is a diagram illustrating exemplary changes in the rotational speed of the pair of intermediate rollers 4 and the rotational speed of the pair of registration rollers 5 when the registration sensor 101 detects arrival of the recording paper P earlier than the appropriate timing. The slowdown control on the pair of intermediate rollers 4 is started after 29 steps from the detection of arrival of the recording paper P by the registration sensor 101 (arrival detection by the registration sensor), that is, after 28 steps from the arrival detection by the registration sensor in FIG. 5A. That is, the slowdown control on the pair of intermediate rollers 4 is started one step earlier in the case of FIG. 5B than in the case of FIG. 5A.

The engine control section 9 decreases the rotational speed of the pair of intermediate rollers 4 from the steady state speed to the starting speed through 50 steps after the start of the slowdown control on the pair of intermediate rollers 4. The engine control section 9 controls the pair of intermediate rollers 4 to rotate at the starting speed by two steps of rotation of the conveyance motor 34 once the slowdown control is complete. That is, the pair of intermediate rollers 4 rotates at the starting speed by one more step in the case of FIG. 5B than in the case of FIG. 5A. The engine control section 9 keeps the pair of registration rollers 5 in the suspended state during a period from the arrival detection by the registration sensor to completion of causing flexing of the recording paper P. After 81 steps from the arrival detection by the registration sensor, the engine control section 9 increases the rotation speed of the pair of intermediate rollers 4 and the rotation speed of the pair of registration rollers 5 from the starting speed (starts the speedup control) in order to start secondary sheet feeding. That is, the engine control section 9 changes the period of time from completion of the slowdown control to start of increasing the rotational speed of the pair of registration rollers 5 according to the change of the starting timing of the slowdown control. The engine control section 9 also changes the period of time from completion of the slowdown control to start of increasing the rotational speed of the pair of intermediate rollers 4 according to the change of the starting timing of the slowdown control.

The pair of intermediate rollers 4 rotates at the starting speed by more steps of rotation of the conveyance motor 34 in the case of FIG. 5B than in the case of FIG. 5A. Accordingly, the period of time from the arrival detection by the registration sensor to the start of secondary sheet feeding for the recording paper P is longer in the case of FIG. 5B than in the case of FIG. 5A. Thus, the period of time from the arrival detection by the registration sensor to completion of causing flexing of the recording paper P is extended when the recording paper P arrives at the registration sensor 101 earlier. As a result, secondary sheet feeding is performed always at a desired timing after an appropriate degree of flexing of the recording paper P is caused.

According to the present embodiment, as described above, it is possible to adjust the timing of secondary sheet feeding by the pair of registration rollers 5 so that desired productivity is achieved. That is, according to the present embodiment, it is possible to cause an appropriate degree of flexing of recording paper while maintaining a constant sheet interval after secondary sheet feeding to ensure a certain degree of productivity. As a result, desired productivity is maintained. Thus, printing quality in high-speed continuous printing is improved.

It should be noted that the present disclosure is not limited to the configuration of the above-described embodiment and is capable of many variations. For example, although a printer has been described in the embodiment as an example of the image forming apparatus according to the present disclosure, the image forming apparatus according to the present disclosure is not limited thereto and may be another image forming apparatus such as a copier, a facsimile machine, and a multifunction peripheral.

The configuration and the processing described with reference to FIGS. 1 to 5B are merely an embodiment of the present disclosure and are not intended to be limiting of the present disclosure.

What is claimed is:

1. An image forming apparatus comprising:

a paper feed section configured to store therein and feed therefrom recording paper;

an image forming section having an image bearing member and being configured to form a toner image on a surface of the image bearing member and transfer the toner image onto the recording paper at a transfer point to form an image on the recording paper;

a conveyance path along which the recording paper is conveyed from the paper feed section to the transfer point;

a pair of registration rollers located upstream of the transfer point in terms of a conveyance direction of the recording paper along the conveyance path and configured to adjust a timing of the conveyance of the recording paper to the transfer point;

a pair of upstream rollers configured to convey, toward the pair of registration rollers, the recording paper being conveyed along the conveyance path;

a first sensor located upstream of the pair of registration rollers in terms of the conveyance direction of the recording paper and configured to detect the recording paper being conveyed from the pair of upstream rollers toward the pair of registration rollers; and a control section configured to perform rotation control on the pair of registration rollers and the pair of upstream rollers in such a manner that the control section controls the pair of upstream rollers to continue to rotate while keeping the pair of registration rollers in a suspended state in order to cause flexing of the recording paper that has arrived at the pair of registration rollers, and then controls the pair of registration rollers to rotate so as to convey the recording paper to the transfer point, wherein the control section performs slowdown control for decreasing the rotational speed of the pair of upstream rollers from a steady state speed to a lower speed limit, the control section controls a starting timing of the slowdown control based on a time when the first sensor detects arrival of a leading end of the recording paper, the control section controls a period of time from completion of the slowdown control to start of increasing the rotational speed of the pair of registration rollers, a period of time from completion of the slowdown control to start of increasing the rotational speed of the pair of upstream rollers, a period of time from the time when the first sensor detects arrival of the leading end of the recording paper to start of increasing the rotational speed of the pair of registration rollers, and a period of time from the time when the first sensor detects arrival of the leading end of the recording paper to start of increasing the rotational speed of the pair of upstream rollers based on the starting timing of the slowdown control, the starting timing of the slowdown control is when a specific period of time has elapsed from the first sensor detecting the leading end of the recording paper, the lower speed limit of the pair of upstream rollers is a starting speed of the pair of upstream rollers, and the starting speed is a rotational speed of the pair of upstream rollers at a time when the control section starts increasing the rotational speed of the pair of upstream rollers to the steady state speed and increasing the rotational speed of the pair of registration rollers to a steady state speed at the same time.

* * * * *